United States Patent [19]

Solomon

[11] Patent Number: 4,646,065

[45] Date of Patent: Feb. 24, 1987

[54] FAULT-TOLERANT CONTROL SYSTEM

[76] Inventor: Elias E. Solomon, P.O. Box 2777, Duxbury, Mass. 02331

[21] Appl. No.: 644,511

[22] Filed: Aug. 27, 1984

[51] Int. Cl.[4] ..... G08B 29/00

[52] U.S. Cl. .....340/511; 340/512; 340/513

[58] Field of Search ..... 340/511, 512, 513, 505, 340/506, 518, 510, 508

[56] References Cited

U.S. PATENT DOCUMENTS 3,716,834 2/1973 Adams ..... 340/505

4,423,410 12/1983 Galvin et al. ..... 340/505

*Primary Examiner*—Donnie L. Crosland

*Attorney, Agent, or Firm*—Wolf, Greenfield & Sacks

[57] ABSTRACT

A fault tolerant control system employing input sensing network and in association therewith a signal processing system which eliminates the effect of radiofrequency interference, electromagnetic interference, transients, and random false alarm signals. The sensing network comprises a linear circuit or a resistor disposed in parallel with one or more semiconductors which are preferably diodes or the like. The network senses current flow so as to provide a signal having a maximum voltage established by the semiconductors with the linear circuit or network providing a linear change in voltage with current until the voltage of the semiconductor is reached when the voltage then becomes nonlinear.

23 Claims, 6 Drawing Figures

D # = DETECTOR NO.

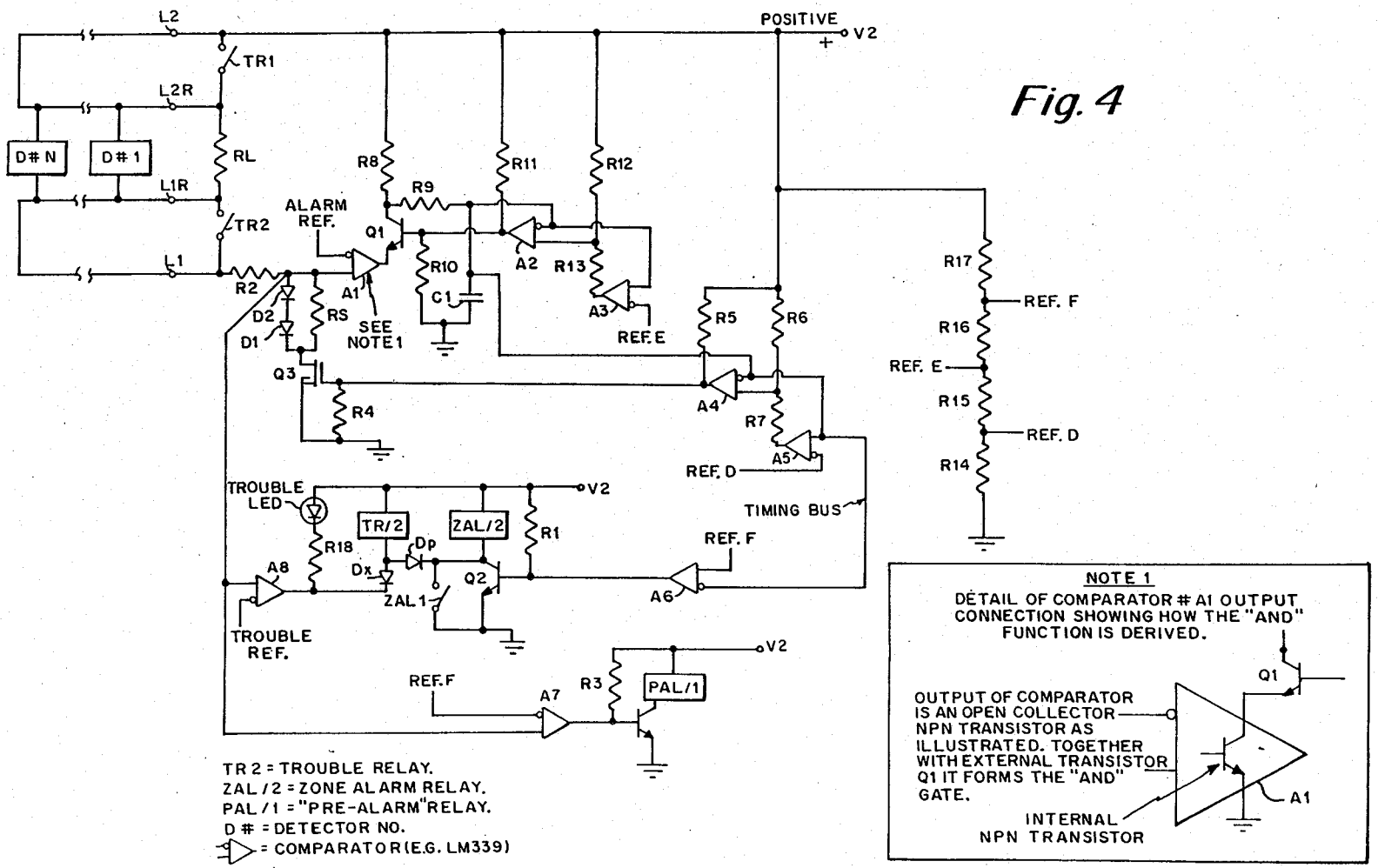
Fig. 4
NOTE 1
DETAIL OF COMPARATOR # A1 OUTPUT CONNECTION SHOWING HOW THE "AND" FUNCTION IS DERIVED.
OUTPUT OF COMPARATOR IS AN OPEN COLLECTOR NPN TRANSISTOR AS ILLUSTRATED. TOGETHER WITH EXTERNAL TRANSISTOR Q1 IT FORMS THE "AND" GATE.
INTERNAL NPN TRANSISTOR
POSITIVE
V2
REF. F
REF. D
REF. E
TIMING BUS
ALARM REF.
SEE NOTE 1
TROUBLE LED
TROUBLE REF.
ZAL/2
TR/2
PAL/1
D# 1
D# N
TR2 = TROUBLE RELAY.
ZAL/2 = ZONE ALARM RELAY.
PAL/1 = "PRE-ALARM" RELAY.
D# = DETECTOR NO.
= COMPARATOR (E.G. LM339)

FAULT-TOLERANT CONTROL SYSTEM

BACKGROUND OF THE INVENTION

The present invention relates in general to a fault-tolerant control system and pertains more particularly to a control system employing an input sensing network in combination with a signal processing system for eliminating false alarms and more particularly for eliminating the effect of radio frequency interference (RFI); electromagnetic interference (EMI); transients (voltage or current); and random false alarm signals.

Fire alarm systems are highly susceptible to false alarms due to the increased sensitivity of smoke detectors to RFI, EMI, transients and random false alarms due to air-velocity or other causes. Detectors are now calibrated to be more sensitive as they have to pass performance tests for a wide range of fires. With the greater use of digital electronics and power controls using various modulation techniques such as pulse width modulation and pulse position modulation, electromagnetic interference and radio frequency interference are steadily increasing problems. Load switching and the proximity of signalling wires to power conductors cause transients which are yet another problem for control systems.

A number of methods have been tried in an attempt to reduce the effect of electrically-induced signals. The usual methods have been to use suppressors, filters and integrators. However, because of the wide spectrum of these signals, the solutions have been both expensive and inadequate. Also, suppression, filtration and integration at the control do not eliminate false-alarms caused by sensors such as smoke detectors false-alarming due to air movement through an ionization chamber, vibration causing optical detectors to alarm, random, non-sustained passage of smoke, dust or condensation through a detection chamber. Electrical induction may also cause a detector to alarm, and suppressors, filters and other noise-reduction means at the control will not solve the problem. All unwanted signals—electrical or otherwise—will henceforth be referred to as "noise".

Another problem with control systems is that an adequate change in signal level has to occur for the system to differentiate between normal variations such as may be caused by signal-line impedance, voltage variations, system loading and an alarm signal caused by a sensor in alarm. In order to develop an adequate signal, the sensing network usually has to have an impedance which is high enough to develop the required voltage when an alarm current flows in the circuit. This impedance has a major drawback in that if more than one sensor is in alarm the voltage lost across this impedance reduces the voltage available to the signalling line. Because sensors usually have relays which control vital functions such as doors and elevators, dampers, vents, fans and other heating and ventilating devices, failure to supply adequate voltage can result in serious problems. For example, failure of a damper can cause the spread of smoke into other areas not directly effected by the fire. An even more serious condition may occur if some relays do operate and then drop out as the voltage drops further. When the relay load is shed, the voltage on the signal line rises and relays again begin to operate. This time, however, they may operate in a different sequence and cause smoke to be deliberately directed to other areas.

The method presently employed to get around this problem is to run separate wires to power the sensors or detectors and to run separate wires to detect the alarm signals. This leads to a great deal of additional expense because of the extra wiring, labor and circuits needed to supervise the power conductor. To economize, systems do not supervise the power conductor to each signaling loop separately and this makes it very difficult to locate the area of a fault.

Accordingly, it is an object of the present invention to provide a fault-tolerant system adapted to overcome all of the aforementioned problems described hereinabove.

PRIOR ART

FIG. 1 illustrates a conventional circuit used as an input sensing means for control systems. Current flowing through the end-of-line (EOL) resistor RL and through the sense resistor RS causes a voltage drop Vs across resistor RS. Resistor R1 and capacitor C1 together provide an integration function which reduces the effect of transients. Diode D1 across resistor R1 allows the capacitor C1 to rapidly discharge when the transient is removed.

When a sensor is in alarm, current through resistor RS increases and this causes a voltage drop across resistor RS. Taking some typical values:

Supervisory current through resistor RL in quiescent state=10 ma. RS=50 ohms, current in alarm=40 ma.

Voltage drop across resistor RS due to supervisory current=10 ma×50 ohms=500 mv.

Current caused by detector switching resistor in alarm=40 ma.

Voltage drop across RS due to alarm current=40 ma×50 ohms=2 volts.

If two detectors are in alarm, the alarm current will be 80 ma.

Voltage across RS due to 80 ma alarm current:=80 ma×50 ohms=4.00 V.

Assuming the usual nominal system voltage of 24 volts dc., it can be seen that it does not take too many detectors in alarm before there is insufficient voltage to allow any more detectors to operate. In fact, if three or more detectors are in alarm, random dropping out and re-energizing of detectors can result as load shedding causes the signal line voltage to increase until more detectors again reduce the signal line voltage thus causing oscillation.

Reducing the value of resistor RS is not a good solution because this will result in very low level signals for the supervisory circuit. A normal quiescent current through resistor RS and the end-of-line resistor RL is on the order of 10 mA. This gives a quiescent voltage of 500 mV for resistor RS=50 ohms. If resistor RS is reduced to 25 ohms the voltage is reduced to 250 mv. The threshold has to be set to a much lower voltage to take into account lower current levels at lower supply voltages. Any circuit which is used to supervise the quiescent voltage will have to have its threshold below this level. Working at very low threshold levels results in circuits which have low noise immunity.

BRIEF SUMMARY OF THE INVENTION

To accomplish the foregoing and other objects, features and advantages of the invention, there is provided a fault tolerant control system that is characterized by multiple improved features including an improved input sensing network and furthermore also characterized by a signal processing system preferably employed in connection with the input sensing network for eliminating the effects of radiofrequency interference, electromagnetic interference, transients, and random false alarm signals. In accordance with the feature of the sensing network, there is provided a network which is comprised of a linear circuit such as a resistor for sensing alarm signals, preferably in parallel with one or more semiconductors illustrated herein as one or more series arranged diodes so that the sensing current flows through the sensing network to provide a signal with the signal having a maximum voltage established by the semiconductors. The linear circuit or resistor network provides a linear change in voltage with current until the voltage with the semiconductor is reached or when the voltage thereafter becomes non-linear. In accordance with another feature of the present invention, there is provided, connected to the sensing network, a comparator or the like means for detecting the voltage above a threshold. The output of the comparator is coupled to the input of another device which is preferably a bi-polar transistor for providing an AND circuit. The AND circuit is preferably connected to a timing circuit. The timing circuit operates for as long as the output from the gate enables it with the output restoring when it is no longer enabled. In addition, there are numerous other features of the present invention which will now be set forth in the claims appended hereto.

BRIEF DESCRIPTION OF THE DRAWINGS

Numerous other objects, features and advantages of the invention should now become apparent upon a reading of the following detailed description taken in conjunction with the accompanying drawing, in which:

FIG. 4 is a detailed circuit diagram of a signal processing system which is connected to each zone or area initiating loop.

DETAILED DESCRIPTION

Figure 1:
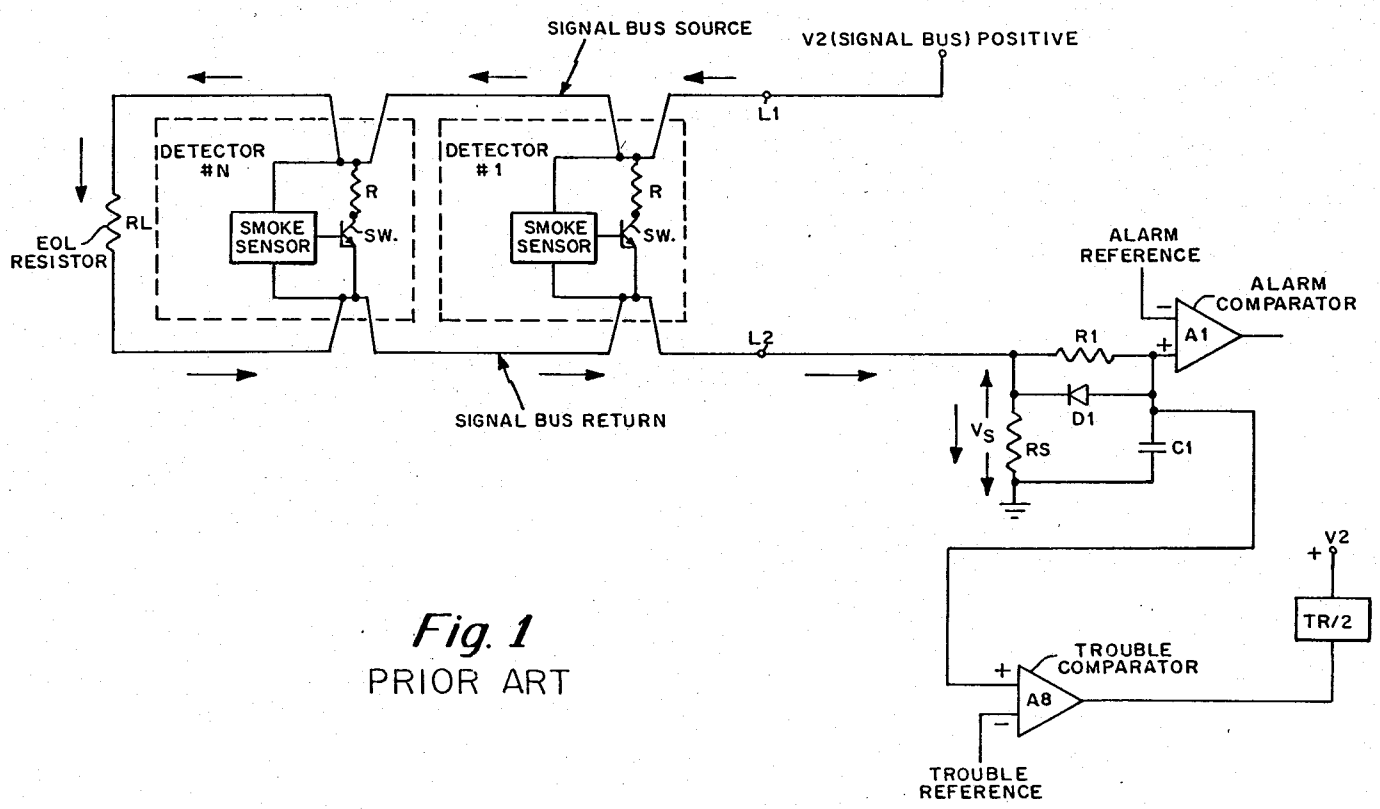
Fig. 1 PRIOR ART
FIG. 1 illustrates a conventional circuit used as an input sensing circuit for control systems.
Figure 2:
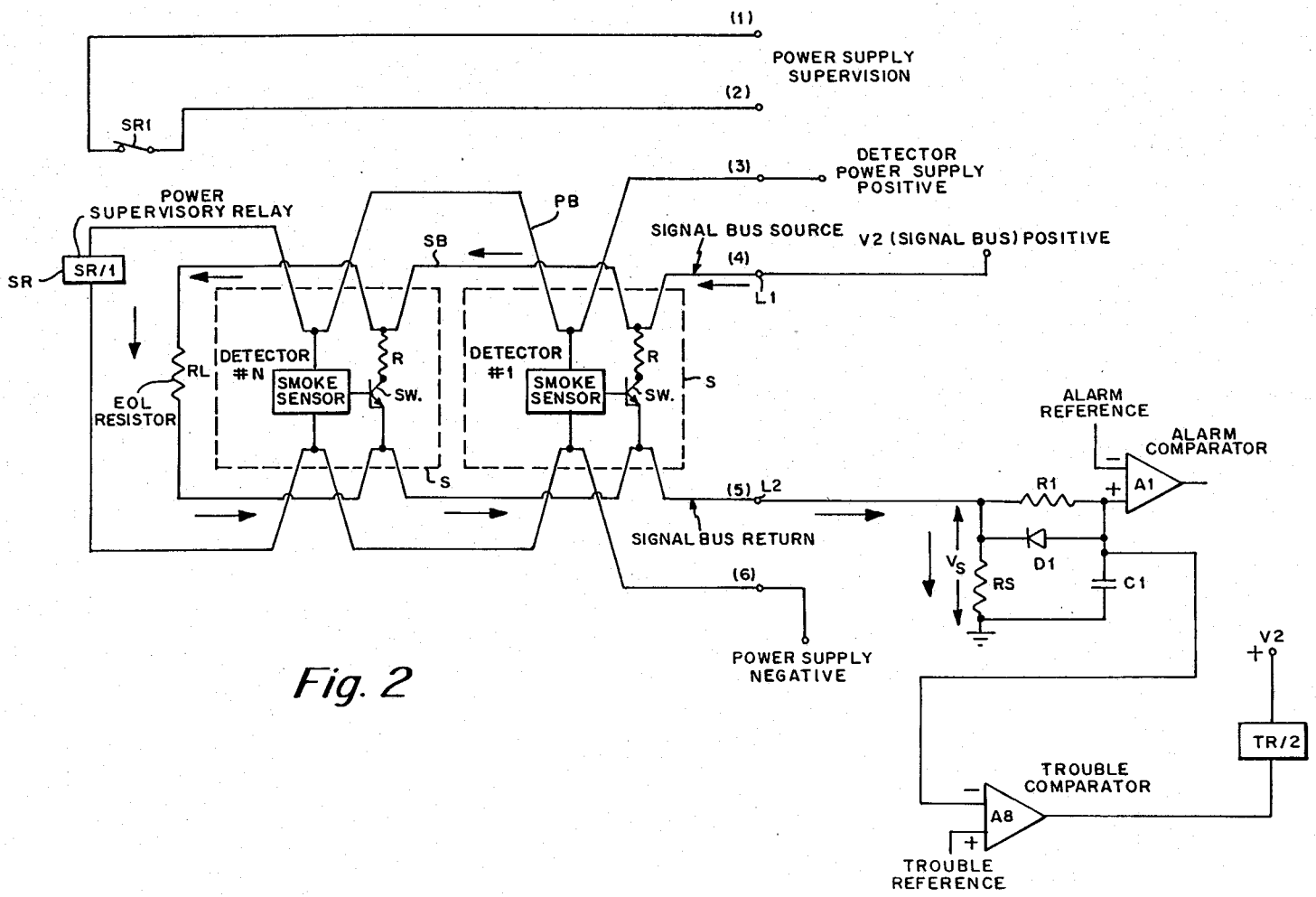
FIG. 2 illustrates a method to overcome the problem of inadequate voltage for detectors in alarm and low quiescent sense voltages.

With regard to the drawings, reference has been made hereinbefore to FIG. 1 which shows a conventional circuit used as an input sensing means for a control system. FIG. 2 shows a schematic diagram of a system that is meant to overcome the problems associated with the prior art circuit of FIG. 1. In FIG. 2 the detector power bus PB provides power to the sensors S and the signal bus SB provides the path for sensor signals from the sensors or detectors S. In FIG. 2, each of the sensors S is illustrated as comprising a resistor R in series with a transistor switch SW.

The transistor switch SW located in the smoke detector is normally off. As indicated previously, it is in series with a current limiting resistor R across the signalling bus SB. Under normal conditions (no alarm), the only current flowing in the signalling loop is caused by the EOL resistor RL. This current flows through the sense resistor RS. The voltage developed across this resistor, VS, is normally below the threshold of comparator A1. Because the detector is not normally receiving power from the signalling bus, the value of this resistor RS can be in the order of a few hundred ohms. This results in a higher threshold for the alarm comparator A1.

When a detector goes into alarm, detector transistor SW switches on and current flows from terminal 4 (which provides positive for the signalling circuit) through the limiting resistor R, and into terminal 5, through resistor RS and to ground. This current causes an increase in the voltage drop across resistor RS such that comparator A1 trips to give an alarm signal.

The separate power bus PB (terminals 3 and 4) provides the voltage necessary to power the detectors S. If the bus is broken, the detectors connected to this bus cannot function. No supervisory trouble signal for the power bus is received at the circuit to which the signalling bus is connected. However, the power bus has a common supervisory circuit which gives a trouble signal when the bus is broken. This is done by powering a common supervisory relay SR from the power bus and by supervising its contacts. As long as the relay is powered, the contacts are closed across terminals 1 and 2. If there is no power on the power bus, the supervisory relay de-energizes and no current flows and the across contacts terminals 1 and 2 open to give a supervisory trouble condition.

The circuit diagram of FIG. 2 has some drawbacks associated therewith as follows:

1. The circuit will require more current in alarm because the signalling line load (resistor R) will have to be switched into circuit in addition to the control relay which is powered from the power supply bus. This relay is used for control of fans, dampers etc.

2. If redundant or alternative power and signal paths are required, the wiring to the detector must be doubled from four to eight. This gives a minimum requirement of 10 wires (4 for power, 4 for signal, 2 for power bus supervision) for a single zone. The invention will describe how better performance can be achieved with only 4 wires per zone while providing for full redundancy (FIG. 4).

3. If a large number of detectors are used in a system and all are powered from the same power bus, very heavy gauge wire will have to be used. (The circuit described in this invention allows for the detectors to be powered directly from the initiating bus and the distribution of power results in smaller gauge wiring).

4. If separate power busses are used for each detector zone, a number of separate terminations must be used (eg. a distribution box). Each of these power busses must be separately supervised thus adding to the complexity of the system. (The circuit described in this invention does not require separate busses as the signal bus supports the detector load).

5. The power-bus supervisory relay(s) cause an additional current drain on the system. As fire alarm systems may require up to 60 hours standby power, even a 20 ma load per relay will result in a 1.2 ampere-hour (20 ma$\times$60 hrs.) additional requirement per power supervisory circuit. This represents as much as 10% of the battery capacity per relay for a moderate alarm system of 10 AH capacity.

Figure 3:
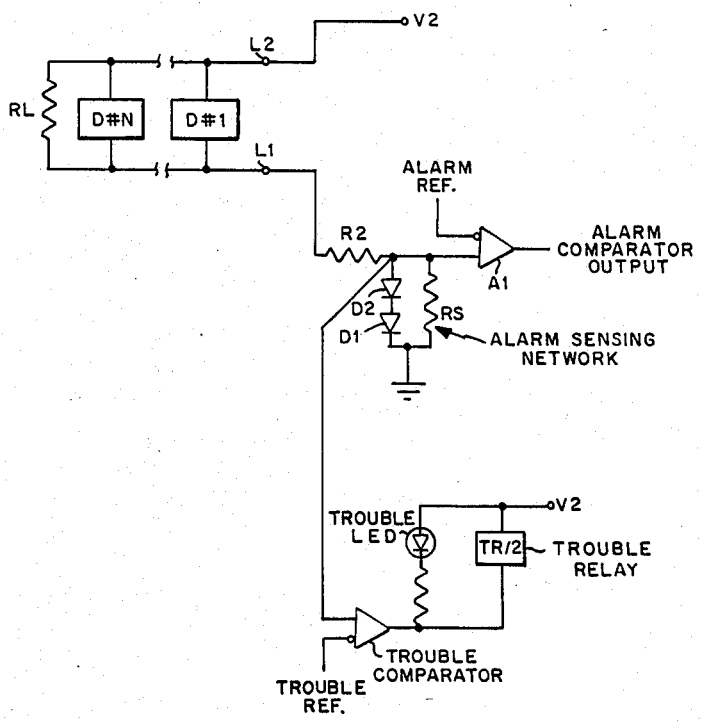
FIG. 3 illustrates one detailed embodiment for the sensing network.

FIG. 3 shows part of the invention. For comparison, the value of resistors are the same as for FIG. 1. i.e.

RS=50 ohms, and RL draws the same signal bus supervisory current of 10 ma.

Voltage across RS in alarm does not equal 40 ma×50 ohms and thus does not equal two volts. The reason for this is that, although a voltage develops across resistor RS as current through increases, as soon as this voltage drop is sufficient to forward bias the diodes D1 and D2, the voltage is clamped by these diodes to approximately 1.2 volts. When no alarm current is present, only the 10 ma signal-bus supervisory current flows through RS. The 10 ma×50 ohms=500 mv voltage across RS is insufficient to forward bias the diodes D1, D2 and so the voltage follows the current x resistance characteristic until the diodes D1, D2 start conducting.

Figure 5:
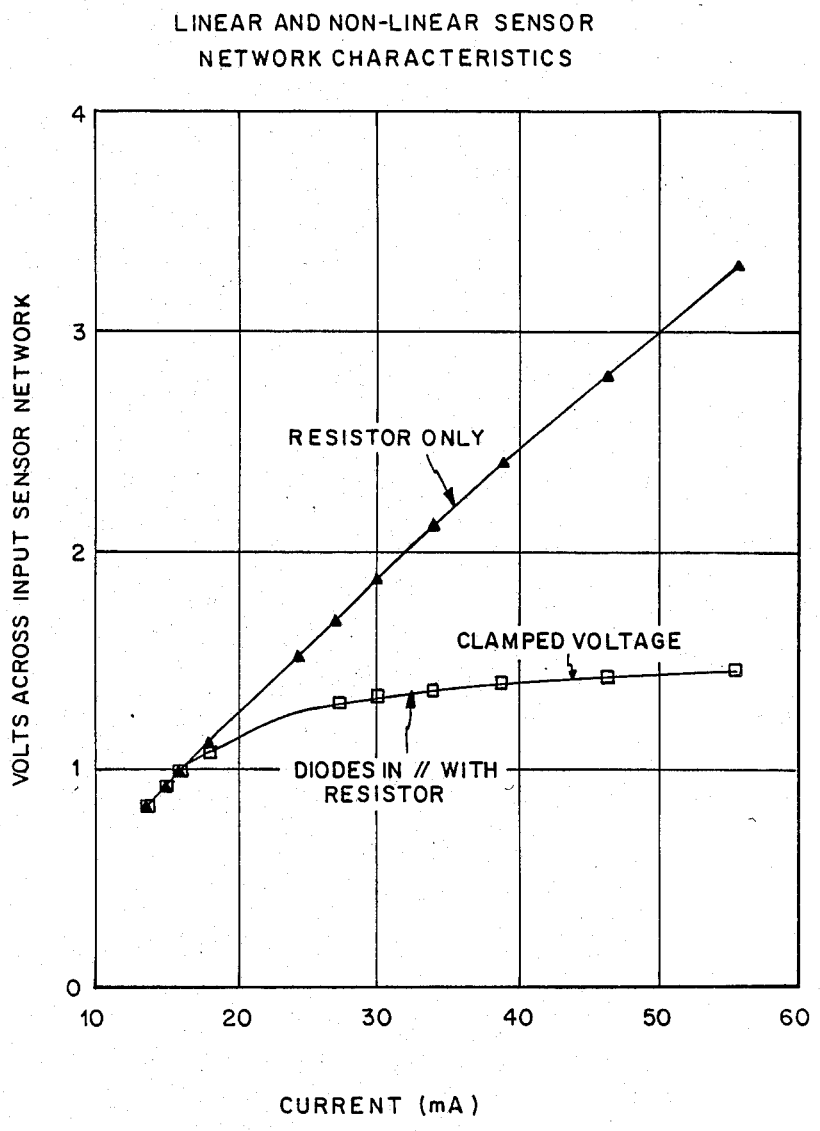
FIG. 5 is a graph illustrating the principles of the present invention.

Graph A (FIG. 5) shows the characteristics of the sensing resistor RS without the clamping diodes D1, D2 and the characteristics of the resistor in parallel with the clamping diodes. Without the resistor to shunt the low-level supervisory current of 10 ma, the diodes would be forward biased continuously and the clamping voltage of 1.2 volts would result. It is the unique characteristic of the resistor shunted diode network illustrated in FIG. 3 which allows for supervisory current to be developed across the sensory resistor RS, while limiting the voltage in the event of any number of detectors being in alarm.

Resistor RS may be varied to cause clamping at any desired current level. Thus, if RS=60 ohms, the forward bias voltage (approx. 1.2 v) for the diodes D1 and D2 in series would be reached when a current of 20 ma flows through the signal bus whereas, if RS=20 ohms, a current of approximately 60 ma will have to flow before the diodes are forward-biased. Alternatively, the number of diodes may be chosen to allow for various current levels before clamping occurs. For example, one diode would cause clamping at approximately 600 mv, two diodes at 1.2 v and so on. Also while diodes are shown in the example, other devices such as zener diodes, band-gap diodes, SCRs etc., can be used. The network is continuously active in that it does not depend on a component being switched across the resistor in order to reduce the voltage across it. A means of switching a linear component across the sense resistor RS, has a major disadvantage in that supervisory current is shunted away from the sense resistor and if there is a fault in the signal bus during an alarm, supervision can be lost. If a resistor or other device is switched across RS, voltage will again be dropped across this additional network as current increases. The use of a clamping network permanently connected across the sense resistor RS provides the simplest and most reliable means of providing the least loss in voltage to the signalling line.

The ability to control the voltage drop through the sensor network is only one step in providing a fault-tolerant system. The other step is to provide rejection of false alarms due to noise is a signal processing technique.

Figure 1A:
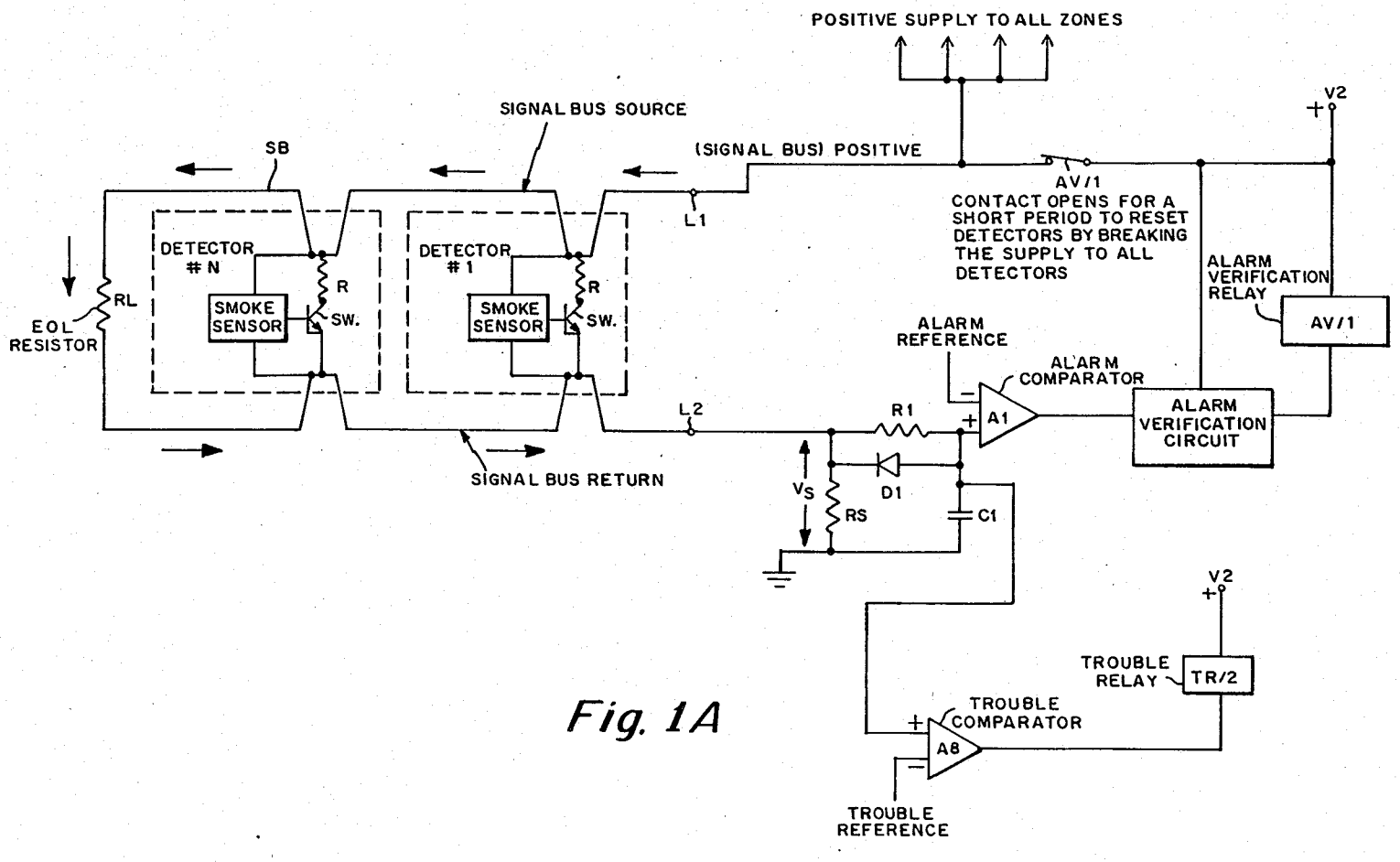
FIG. 1A is a schematic diagram illustrating the principles of current verification.

When a detector goes into alarm, control systems process this as a genuine alarm if the alarm current persists for a few seconds. While this may be an adequate solution for some types of transients and induced signals, it is totally useless if the detector itself is in alarm due to "noise". One method currently in use is a verification system which works as follows:

FIG. 1A is a simplified schematic which demonstrates the principle of current verification procedures. When a detector causes an increased current flow in the signalling bus 5B (connected across L2, L1 terminals), comparator A1 (FIG. 1A), senses the increased voltage across resistor RS and switches the alarm verification circuit. Relay AV/1 energizes and contact AV1 opens to switch off power to the whole system (i.e. all the zones and all the detectors). This causes the detectors in alarm to de-energize. A typical alarm verification circuit has a time delay and after it times out, power is restored to the system. If any detector in the whole system goes into alarm within the following few seconds, the signal is processed as a genuine alarm. If no alarm is received in the few seconds after the verification circuit has timed out, the system resets. An important point to note is that the system does not discriminate if the "verification" alarm came from the same detector, from a detector in the same area or from a detector anywhere in the system. It takes as confirmation any detector connected to anywhere in the system going into alarm. As systems can, and do, have many hundreds and, often thousands of detectors, this has proven to be an inadequate method of verification. As detectors are switched off and then on again in close sequence, the detectors can re-alarm due to differing rise and fall times of its output and threshold levels. This is especially a problem if a detector is very sensitive or close to alarm level. The cost of circuitry to verify detectors in alarm by area or zone by conventional means can be very high. What this invention shows is an inexpensive and improved means of verifying alarms.

FIG. 4 is a schematic in accordance with the present invention of a signal processing system which is connected to each zone or area signaling bus. It is therefore specific to that area or zone and does not effect the rest of the system.

FIG. 4 shows the detectors D1–DN connected to associated lines L1, L2, L1R, and L2R. Included in the circuit of FIG. 4 is the comparator A1 which is the basic alarm reference comparator. FIG. 4 also shows in the insert, further details of the comparator A1 illustrating the circuit "and" function. The output of the comparator is an open collector NPN transistor as illustrated along with an external transistor which is transistor Q1 forming an "AND" gate.

Normally comparator A1 has its output low. This makes the emitter of transistor Q1 low. Transistor Q1 is switched on by comparator A2 whose output is high. The collector of transistor Q1 clamps the voltage across the capacitor C1 to ground (negative).

When an alarm signal is received, the circuit first checks if it was from a detector or was caused by noise in the following manner:

When an alarm voltage is sensed by comparator A1, its output is no longer low. The output of comparator A1 is in series with transistor Q1 and together they form an AND gate since both of them must conduct at the same time for the collector of Q1 to switch low. If comparator A1 output switches off (it has an open collector which is connected to Q1 emitter), Q1 emitter is disconnected from ground (negative) and the short circuit across capacitor C1 is removed. Capacitor C1 now charges via current from the positive supply V2 through resistor R8. If the alarm level signal into comparator A1 was caused by noise induced in the signalling bus, and not by the detector, it will be cyclical in nature and comparator A1 will switch on and off as this signal varies. The threshold of comparator A2 is formed by resistor network R12, R13 and the output of comparator A3 which is normally low. The threshold of comparator A4 is formed by resistors R6, R7 and the output of comparator A5 which is normally low. The values of these resistors are such that these thresholds are at the same level. When the short circuit across timing capacitor C1 is removed, capacitor C1 starts to charge via resistor R8. Capacitor C1 will have to charge for at least 20 ms before it reaches the thresholds of comparators A2 and A4. This means that the alarm signal must persist for at least this time before it is recognized as a possible alarm. If the signal does persist for this minimum period of time, comparators A2 and A4 outputs switch low.

When comparator A2 switches low, it causes transistor Q1 to switch off. Thus, if comparators A1 now switches low, the capacitor C1 will not discharge because transistor Q1 has broken the discharge path. When comparator A4 output goes low, it causes transistor Q3 to switch off. This in turn removes negative from the detector circuit and causes the detectors connected to that zone only to switch off. Capacitor C1 continues to charge as transistor Q1 is still off. When capacitor C1 charges to the threshold level (reference D) of comparator A5, it causes the output comparator A5 to switch high. This in effect disconnects resistor R7 from ground and the full supply voltage is available at the non-invert input of comparator A4. Comparator A4 output goes high to switch transistor Q3 back on and power is restored to the detectors.

Comparator A2 output is still low because the threshold of comparator A3 (reference E), is higher than reference D of comparator A5. This means that transistor Q1 will remain off and capacitor C1 has no discharge path even if comparator A1 output is low. This results in capacitor C1 charging irrespective of the state (alarm or normal) of the signalling circuit. The circuit in effect completely ignores any signal originating from the rest of the system while transistor Q1 is off. During this time the detectors are given time to stabilize and to re-alarm if there is in fact an alarm condition. As smoke detectors have an inherent time delay, they require a few seconds to respond to smoke alarm conditions so the delay while capacitor C1 continues charging serves the purpose of both ignoring noise during this period and allows time for the system to stabilize.

When capacitor C1 charges to the threshold of comparator A3 (reference E,) comparator A3 output switches high which in turn switches comparator A2 off. Comparator A2 output goes high to switch transistor Q1 on.

One of three conditions is now possible at the emitter of transistor Q1:

1. Comparators A1 output is low because the detectors and signalling bus are normal (no alarm level signals). This pulls the emitter of transistor Q1 low and as transistor Q1 is now on, capacitor C1 discharges rapidly through low value resistor R9. This restores the circuit to its normal condition before it received an alarm level signal.

2. Comparator A1 output is high due to noise in the signalling bus. Capacitor C1 continues to charge. However, as noise is cyclical or random in nature, the output of comparator A1 will periodically go low and will complete the path for capacitor C1 to discharge when it is low. The circuit will rapidly restore to normal.

3. Comparator A1 output is high due to a detector going into alarm. Capacitor C1 continues to charge. Now as the smoke detector signal is sustained, comparator A1 output remains high and so capacitor C1 continues to charge. If this charging continues for at least 20 ms, the threshold of comparator A6 (reference F) will be exceeded and the output will go high to switch alarm relay ZAL/2 via transistor Q2. This relay is latched via contact ZAL1.

The verification procedure described above provides for a period of time during which the verification proceeds independently of the status of the alarm input. The circuit is in effect blind to transients and other induced noise occurring during this timing period. When adequate time, at least three seconds to allow for the system to stabilize and detectors which have sensed a fire condition to re-alarm, has elapsed, the circuit examines the condition of the alarm input as reflected by comparators A1. If there is no alarm level signal, it immediately restores. If there is a signal at alarm level, the system verifies that it is there for at least 20 ms before it processes it as an alarm.

Another major advantage of this method of verification is that in a large system with many hundreds or thousands of sensors, the probability of a random alarm level signal occurring within a certain time frame is greater if a large number of detectors are processed by one verification system. By subdividing the system into a number of verification circuits, the probability of an unwanted alarm is greatly reduced. The other factor which contributes to unwanted alarms is the transients which are introduced when a large number of detectors are switched off and then on again during the verification procedure. By reducing the number of detectors that have to be verified at one time, the probability of a false alarm is greatly reduced. The system takes some time to stabilize and by having a processing system which is blind during the time this occurs, problems are avoided.

When a system goes into its verificatin cycle, it is desirable to know that a possible alarm condition did exist. This would help identify a signalling bus to which problem detectors are connected and which periodically do go into alarm. It would also help identify those signal buses which are noisy.

To achieve this, the signal from the signal bus is monitored by another comparator A7 (FIG. 4). When transistor Q3 is switched off during the verification cycle, the voltage at the anode of diode D2 goes to supply potential. This causes the threshold of comparator A7 (reference F), to be exceeded and its output to switch high and this in turn causes transistor Q4 to switch "pre-alarm" relay PAL/1 on. This relay can be used to give an indication that the zone went through a confirmation cycle.

The next advantage of this sytem is the reduction in the wiring necessary if redundancy is required. In order to give redundant power/signal paths with this invention, a total of 4 wires only is required. 4-wire circuit connections (known as Class A wiring in the fire alarm industry) has been in use for a number of years. What is different about this invention is that the 4 wire connection can be used to deliver adequate voltage without too much of a loss in voltage across the sensor network. Other systems would require at least 10 wires to achieve only part of the performance. The following describes how the Class A system of wiring works: If a wire breaks, the voltage at diode D2 anode goes to ground potential. This loss in voltage is detected by comparator A8 which switches and latched relay TR/1 and a light emitting diode TL1 to give an indication of a signal-line fault. The contacts of this relay are used to switch terminal L1 to L1R and terminal L2 to L2R thus providing an alternative path and at the same time giving an indication that the signalling path was broken. If the sensing circuit, such as used with the usual systems, drops too great a voltage, the signalling and the power supply wiring will have to be separate as shown in FIG. 2. In addition, the wiring will have to be doubled in order to achieve Class A wiring where alternative paths are provided if the primary path fails.

A further improvement is possible by using relay TR/1 for a dual purpose. This relay is normally used, in Class A circuits, to repair the signalling path when comparators A8 recognizes a broken wire. However, relay TR/2 can also be used to make the circuit more fault tolerant. To understand how this works, consider the 4-wire signalling circuit (FIG. 4). Initially, power to the detectors is routed from V2 via terminal L2 to the signal wires to which the positive of the detectors are connected, to terminal L2R, through the EOL resistor RL, to terminal L1R, back to the signalling line to which the negative of the detectors are connected, through the return path to terminal L1 which is connected through the sensing network to ground. For example, the impedance of the path to the furthest detector (N) is the sum of the impedance of the wiring between terminal L1 and detector N and terminal L2 and detector N. The only purpose of contacts TR1 and TR2 was, until now, (as described earlier), to connect the alternative paths if a signal line breaks. An improvement can be made to increase the fault-tolerance of the circuit by using the trouble relay contacts for the dual purpose of decreasing the impedance of the signalling circuit in alarm conditions (when a lower impedance is most required) to deliver a higher voltage to the detectors. To achieve this, the trouble relay is also energized when the zone goes into alarm (this is done without energizing the trouble circuit as it is not desirable to cause a trouble signal when no trouble exists). This causes the relay contacts to transfer and to connect L1 to L1R and L2 to L2R. This results in, for example, detector N to signal and receive power by the wires connected to L1 and L1R in parallel and L2 and L2R in parallel, thus reducing the impedance by 50%. This applies to all the detectors connected to the signal wires. In order to avoid giving a trouble signal even though the trouble relay is energized, the trouble relay is isolated from its drive comparator A8 by means of a diode Dx. The negative switched to the trouble relay TR/1 is blocked from the rest of the trouble circuit by diode Dx. In alarm condition, transistor Q2 switches the trouble relay via a diode Dp. This also blocks the trouble relay from energizing the alarm relay ZAL/2 if there is a trouble. What this has done is to greatly add to the reliability of an alarm system at the cost of two diodes which together cost less than 5 cents. The system also becomes more fault tolerant as an increase in signal line impedance will not effect the ability of the supply to deliver adequate voltage to the detectors.

The circuit has the advantage in that the trouble indicating means (e.g. a light emitting diode or buzzer) is not inhibited but isolated (by diode Dx) in the event of the alarm. This means that if the wiring to the detectors break, even subsequent to an alarm, the trouble comparator A8 will still respond and cause the LED, buzzer or other indicating means to show a fault condition. The trouble responsive circuit is active at all times.

Having described one embodiment of the present invention, it should now be apparent to those skilled in the art that numerous other embodiments are contemplated as falling within the scope of this invention.

What is claimed is:

1. A fault tolerant control system having an input sensing network for sensing signals from one or more detectors in which said detectors are disposed in a parallel array, said sensing network comprising, a linear element, a non-linear element, means disposing the linear and non-linear elements in parallel, means coupling signals from at least one said detector to the sensing network to provide a signal having a maximum voltage established by the non-linear element, said linear element providing a linear change in voltage with current until the voltage of the non-linear element is reached whereby said voltage then is controlled by said non-linear element and means coupled from said parallel disposed linear and non-linear elements for detecting said voltage signal.

2. A fault tolerant control system as set forth in claim 1 wherein said linear element comprises a resistor.

3. A fault tolerant control system as set forth in claim 2 wherein said non-linear element comprises a unilateral device.

4. A fault tolerant control system as set forth in claim 3 wherein said unilateral device comprises at least one diode.

5. A fault tolerant control system as set forth in claim 4 comprising a pair of series connected diodes.

6. A fault tolerant control system as set forth in claim 1 wherein said a means for detecting senses a voltage above a predetermined threshold and includes an AND circuit means.

7. A fault tolerant control system as set forth in claim 6 wherein said means for detecting comprises a comparator and further including an output transistor forming with the comparator said AND circuit.

8. A fault tolerant control system as set forth in claim 7 further including a timing circuit, said AND circuit being connected to said timing circuit.

9. A fault tolerant control system as set forth in claim 8 wherein the timing circuit operates for as long as the output of the AND circuit enables it, said output restoring when it is no longer enabled.

10. A fault tolerant control system as set forth in claim 8 wherein the timing circuit restores after approximately three seconds after the AND circuit input enables it for more than 20 milliseconds.

11. A fault tolerant control system as set forth in claim 8 wherein the timing circuit continues its timing function for at least three seconds during which time it causes the output to a powered circuit to be interrupted for at least five milliseconds subsequent to which it restores the power to the circuit.

12. A fault tolerant control system as set forth in claim 10 wherein the timing circuit causes the output of the AND circuit to continue enabling the timing circuit for at least three seconds irrespective of the condition of the input circuit.

13. A fault tolerant control system as set forth in claim 12 wherein the timing circuit causes the AND circuit to continue enabling the timing circuit after at least three seconds provided the input circuit is at or above the alarm threshold, said timing circuit to restore if the input circuit is below the alarm threshold.

14. A fault tolerant control system as set forth in claim 12 wherein the timing circuit causes the AND circuit to restore the timing circuit after at least three second provided the input circuit is below the alarm threshold level.

15. A fault tolerant control system as set forth in claim 13 wherein the timing circuit causes an alarm signal after a further period of at least approximately 100 milliseconds provided the input is above the alarm threshold continuously during this period.

16. A fault tolerant control system as set forth in claim 1 wherein each of said detectors has positive and negative feeds including connecting the positive feed via two wires and the negative feed via two wires such that if any one wire breaks, the two positive feeds to the detectors are connected together and the two negative feeds to the detectors are connected together, said connections also being made if the circuit is an alarm.

17. A fault tolerant control system as set forth in claim 16 including means for causing the connections without causing a trouble signal or indication, such means including the use of a means of isolating the trouble indicating means from the trouble responsive means if the connections are caused by an alarm.

18. A fault tolerant control system having an input sensing network and a signal processing system which includes means for detecting a voltage signal above a predetermined threshold, a semiconductor control device having a control electrode and at least one output electrode, said means for detecting comprising a comparator means having an input for receiving said voltage signal and an output, said comparator means and semiconductor control device defining an AND circuit, said AND circuit having one input defined by said comparator means input, a second input defined by said semiconductor control device control electrode, and an output defined at the semiconductor control device output electrode and an output charging circuit connected from said semiconductor control device output electrode, wherein said charging circuit includes a timing circuit and wherein said timing circuit operates for as long as the semiconductor control device enables it.

19. A fault tolerant control system as set forth in claim 18 wherein said semiconductor control device has two output electrodes one defining the AND circuit output and the other coupling to the comparator means output.

20. A fault tolerant control system as set forth in claim 19 wherein the timing circuit will not restore operates absent restoration for at least a predetermined interval after the AND circuit enables it for more than a second predetermined interval with said second interval being much smaller than said first interval.

21. An alarm system comprising; a plurality of alarm detectors, a signal bus having bus lines, means coupling the alarm detectors in a parallel array between bus lines of the signal bus, means for applying power to the signal bus, a sensing network including a linear element, a non-linear element and means coupling the linear and non-linear elements in parallel, means coupling the signal bus to said sensing network, said sensing network providing a signal having a maximum voltage established by the non-linear element, said linear element providing a linear change in voltage with current until the non-linear element control voltage is reached, and means coupled from said sensing network for detecting said voltage signal.

22. An alarm system as described in claim 21 wherein said non-linear element is substantially open circuited up to a predetermined threshold voltage and then becomes substantially short circuit thereabove.

23. An alarm system as described in claim 21 wherein said linear element comprises only a resistance means and said non-linear element comprises a unilateral conducting means.

* * * * *